United States Patent [19]

Nishimoto

[11] 4,297,933

[45] Nov. 3, 1981

[54] ELECTRONIC MUSICAL INSTRUMENT FOR TONE FORMATION BY SELECTABLE TONE SYNTHESIS COMPUTATIONS

[75] Inventor: Tetsuo Nishimoto, Hamamatsu, Japan

[73] Assignee: Nippon Gakki Seizo Kabushiki Kaisha, Hamamatsu, Japan

[21] Appl. No.: 94,084

[22] Filed: Nov. 14, 1979

[30] Foreign Application Priority Data

Nov. 16, 1978 [JP] Japan ..... 53-141466

[51] Int. Cl.[3] ..... G10H 1/06; G10H 5/00

[52] U.S. Cl. ..... 84/1.01; 84/1.19; 84/1.22

[58] Field of Search ..... 84/1.01, 1.03, 1.11, 84/1.19, 1.22, 1.24, DIG. 23

[56] References Cited

U.S. PATENT DOCUMENTS 4,128,032 12/1978 Wada et al. ..... 84/1.01

4,189,970 2/1980 Woron ..... 84/1.19

*Primary Examiner*—S. J. Witkowski

*Attorney, Agent, or Firm*—Spensley, Horn, Jubas & Lubitz

[57] ABSTRACT

An electronic musical instrument is of a type in which musical tone signal waves are formed by calculation under wave forming algorithm in an algorithm circuit. The algorithm circuit has a plurality of arithmetic circuits connected by gates. Control signals are applied to the gates and the arithmetic circuits to constitute a certain algorithm performing circuit connection depending upon a selected king of tone. These control signals are sequentially produced at predetermined timing from a pitch data generation circuit, an envelope generation circuit, and an algorithm control data generation circuit.

For calculation of tone waves of different tone colors, different types of algorithm performing circuits are established, thereby realizing wide variety of tone properties.

6 Claims, 5 Drawing Figures

ELECTRONIC MUSICAL INSTRUMENT FOR TONE FORMATION BY SELECTABLE TONE SYNTHESIS COMPUTATIONS

BACKGROUND OF THE INVENTION

This invention relates to an electronic musical instrument and, more particularly, to a digital type electronic musical instrument capable of producing tone signal waves by calculation under algorithms wherein different set of computations provide different kinds of tone (properties, e.g., different tone colors).

In a prior art electronic musical instrument of a type wherein tone signals (or tone source signals) are produced by implementing a predetermined algorithm, this algorithm is a fixed one and tones of various tone colors are produced by this fixed algorithm. In an electronic musical instrument employing a frequency modulation technology, for example, a basic algorithm is implemented by the following equation (1);

$$e(t)=A(t)\sin\{n_1\omega t+I(t)\sin n_2\omega t\} \quad (1)$$

where A(t) is a coefficient determining magnitude of the amplitude of a calculated waveform (i.e. envelope amplitude), I(t) is a coefficient determining depth of the modulation (modulation index), $n_1\omega$ and $n_2\omega$ are angular velocities respectively determining the frequency of the carrier and that of the modulating wave, which angular velocities correspond to the tone pitch of a depressed key.

In this type of electronic musical instrument, algorithm is also implemented by the following equation (2) which is so to speak a multi-series application of the equation (1).

$$e(t)=\sum_{k-1}^{m} A_k(t)\sin\{n_{1k}\omega t+I_k(t)\sin n_{2k}\omega t\} \quad (2)$$

where $A_k(t)$, $I_k(t)$, $n_{1k}\omega$, $n_{2k}\omega$ are the same as A (t), I(t) $n_1\omega$ and $n_2\omega$ for every $k=1, 2, 3, \ldots, m$.

The algorithm is also implemented by the following equation (3) which is obtained by turning the equation (1) to polynominal (multi-term fashion):

$$e(t)=A(t)\sin\{n_1\omega t+\sum_{k=1}^{m} I_k(t)\sin n_{2k}\omega t\} \quad (3)$$

where A(t), $I_k(t)$, $n_1\omega$, $n_{2k}\omega$ are the same as the above described values.

The algorithm in this type of electronic musical instrument is also implemented by the following equation (4) which is obtained by nesting the equation (1):

$$e(t)=A(t)\sin[n_1\omega t+I_1(t)\sin\{n_2\omega t+I_2(t)\sin n_3\omega t\}] \quad (4)$$

in which a subjected to frequency modulation in a double mode. A(t), $I_1(t)$, $I_2(t)$, $n_1\omega$, $n_2\omega$ and $n_3\omega$ are the same values as those described above.

Although there have been proposed various devices for producing tones by implementing algorithm described above, each of these devices can carry out only one of the described algorithms, i.e. only a fixed type algorithm peculiar to the device.

It should be noted, however, that harmonic spectra of tone signals obtained by implementation of the above described algorithms are different from one another so that no single one of the algorithms can achieve production of all kinds of tone colors (tone properties). For example, a tone signal produced by implementation of calculation in accordance with the equation (1) is suited for synthesis of certain particular tone colors but not for synthesis of other tone colors. The same is the case with a tone signal produced by implementation of the equation (2), (3) or (4).

Accordingly, the prior art devices which employ a fixed algorithm (i.e. only one kind of algorithm) have limitation in the range of tone color (tone properties) produced by the device with a result that sufficient variety in the tone color can hardly be obtained.

SUMMARY OF THE INVENTION

It is, therefore, an object of the present invention to provide an electronic musical instrument capable of generating tone signals which are most suited for respective selected kinds of tones (of selected properties by implementing computation under selected one of different algorithms according to the selection of tone kind (typically a tone color) and thereby imparting variety to the produced tone.

According to the present invention, algorithm of a tone signal forming circuit is sequentially controlled in accordance with algorithm control data stored in an algorithm or computation control circuit in correspondence to respective tone colors (properties). The tone signal forming circuit comprises arithmetic circuits composed of memories, adders, multipliers etc. which are connected to one another through gates or latch circuits. Each of the gates (or latch circuits) is sequentially controlled by algorithm control data outputted by the algorithm control circuit. The tone signal forming circuit implements computation in accordance with combination of the arithmetic circuits which combination is determined by the algorithm control data. In an electronic musical instrument employing a key assigner and thereby being capable of producing a plurality of tone simultaneously, the computation is carried out within one channel time of the key assigner. If, for example, this computation is carried out by calculation of six steps, the algorithm control circuit outputs algorithm control data of six steps within one channel time.

A preferred embodiment of the invention will now be described in conjunction with the accompanying drawings.

DESCRIPTION OF A PREFERRED EMBODIMENT

Figure 1:
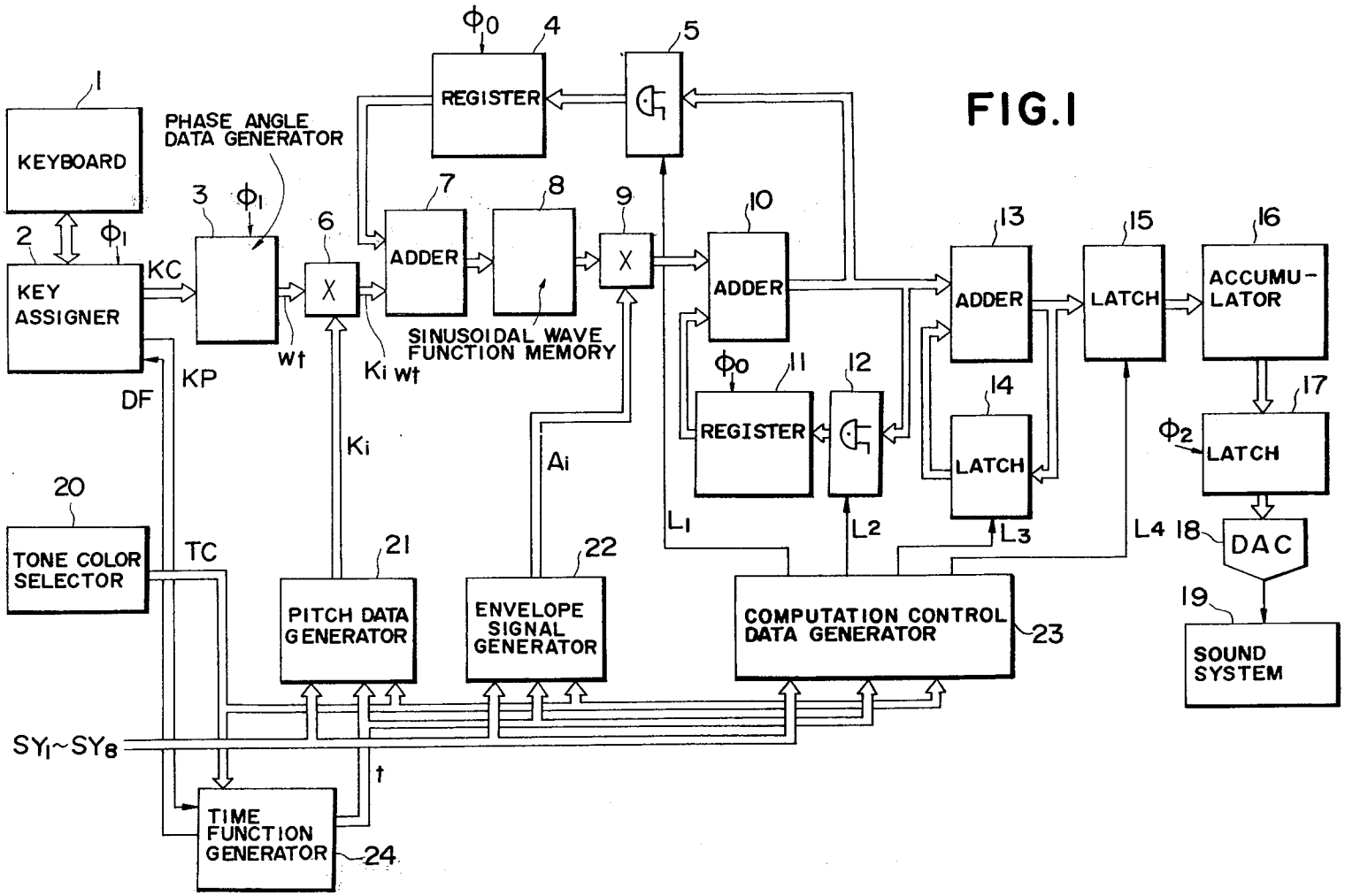
FIG. 1 is a block diagram showing an embodiment of the invention.

Referring to FIG. 1 which shows an embodiment of the present invention in the form of a block diagram, various algorithms performed in accordance with the frequency modulation system are controlled by 4-bit algorithm control data $L_1$–$L_4$ outputted by an algorithm control data generation circuit 23.

Figure 2:
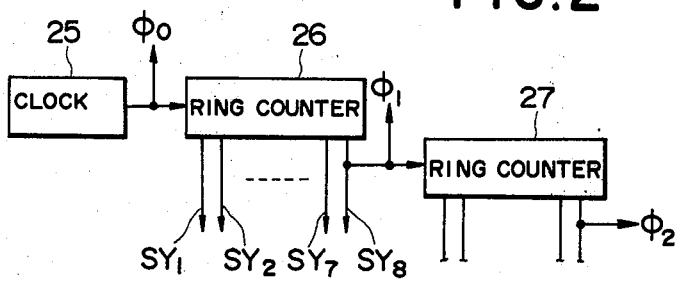
FIG. 2 is a block diagram showing an example of a circuit which generates clock pulses concerning the illustrated embodiment.

A key depressed in a keyboard 1 is detected by the key assigner 2. The key assigner 2 has tone production channels corresponding to a maximum number of tones to be produced simultaneously (e.g. twelve), assigns a key code KC representing the detected key to one of the available tone production channels and delivers out the assigned key code KC as a time division multiplexed signal with the channel times corresponding to the respective channels being used as time slots for the time division multiplexed signal. This key assigner 2 is driven by the clock pulse $\phi_1$ and the above described channel time corresponds to the period of this clock pulse $\phi_1$. The clock pulse $\phi_1$ is obtained, as shown in FIG. 2, from a final stage of an 8stage ring counter 26 to which a master clock pulse $\phi_0$ generated by a clock pulse generation circuit 25 is applied. One shot of the clock pulse $\phi_1$ is generated for every eight shots of the master clock pulses $\phi_0$. As the key assigner 2 has assigned a key code KC representing the depressed key to any of the tone production channels, the key assigner 2 outputs a key-on pulse KP of a predetermined pulse width at the channel time corresponding to the tone production channel to which the key code KC has been assigned.

The time division key codes KC outputted by the key assigner 2 using the respective channel times as time slots are applied to a phase angle data generation circuit 3. The phase angle data generation circuit 3 outputs, upon receipt of the time division key code KC, a signal representing a phase angle $\omega t$ corresponding to each key code KC also as a time division signal. This phase angle data generation circuit 3 can be composed of a read-only memory (ROM) storing frequency information $\omega$ and utilizing the key code KC as address signal and an accumulator circuit accumulating the outputs of this read-only memory in response to a preset clock.

A tone color selection circuit 20 outputs a tone color selection signal TC representing a tone color selected from tone colors $TC_1$–$TC_n$. This circuit 20 is driven by a suitable means such as a tone selection switch (not shown).

Figure 3:
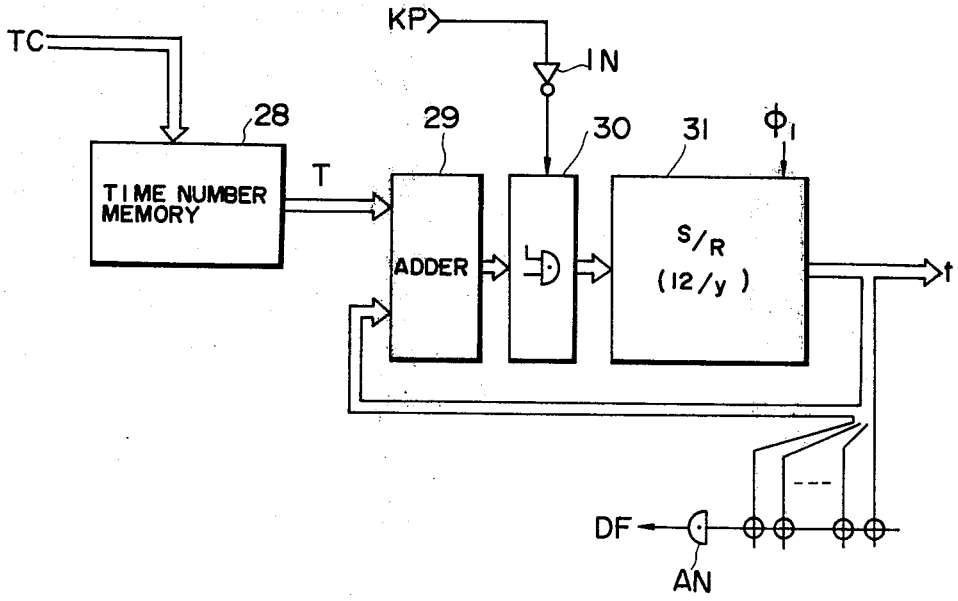
FIG. 3 is a block diagram showing an example of a time function generation circuit in detail.

A time function generation circuit 24 receives the time division key-on pulse KP generated by the key assigner 2 and using the respective channel times as time slots and thereupon generates time function t(t=0 through t=m) corresponding to the key code KC which has been assigned to the respective channels. The time function t represents lapse of time required for forming a tone signal corresponding to the key code KC assigned to the respective channels. The envelope is developed in accordance with the time function t and the time point when the key-on pulse KP appears is designated by time function t=0 and the time point when the envelope finishes by time function t=m. The time function generation circuit 24 can be composed, for example, of a circuit as shown in FIG. 3. In FIG. 3, a time number memory 28 consists, for example, of a read-only memory which stores predetermined numerical data (i.e. time number T) using the tone color selection signal TC as an address signal. The time number memory 28 provides a predetermined time number T in response to the applied tone selection signal TC. This time number T determines a speed at which the time function t proceeds. As the time number T increases, this speed increases and vice versa. The time number T read from the time number memory 28 is applied to an adder 29.

The output of the adder 29 is applied to a 12-stage/y-bit shift register 31 driven by the clock pulse $\phi_1$ through a gate circuit 30 which is gated by a signal obtained by inverting the key-on pulse KP supplied by the key assigner 2 by an inverter IN. The output of the final stage of this shift register 31 constitutes another input signal to the adder 29. Alternatively stated, the adder 29, the gate 30 and the shift register 31 constitute an accumulator which accumulate the time number T supplied by the time number memory 28 in a time sharing fashion. The key-on pulse KP is utilized as a clear signal for clearing the contents of the accumulator. If, for instance, the key code KC representing the depressed key assigner 2 has been assigned to a certain channel and thereupon the key-on pulse KP has been generated at a channel time corresponding to this channel, contents of the shift register corresponding to this channel are cleared in response to this key-on pulse KP and subsequently the accumulator consisting of the adder 29, the gate 30 and the shift register 31 accumulates the time number T provided by the time number memory 28 at each clock pulse $\phi_1$. The shift register 31 provides an accumulated value at a corresponding time slot. Thus, the accumulated value outputted by the shift register 31 at a time slot of a corresponding channel time constitutes the time function t. For this time function t, all output bits of the shift register 31 need not be used but only a part of bits counted from the most significant bit may be used. When the result of accumulation of the time number T provided by the time number memory 28 has reached a value in which all bits are "1", an AND gate AN inputs of which are connected to all of the output bits of the shift register 31 is enabled at a channel time corresponding to this channel and a signal "1" is outputted by the AND gate AN. This output of the AND gate AN (i.e. "1") is fed to the key assigner 2 as a decay finish signal DF showing the end of the envelope.

Figure 4:
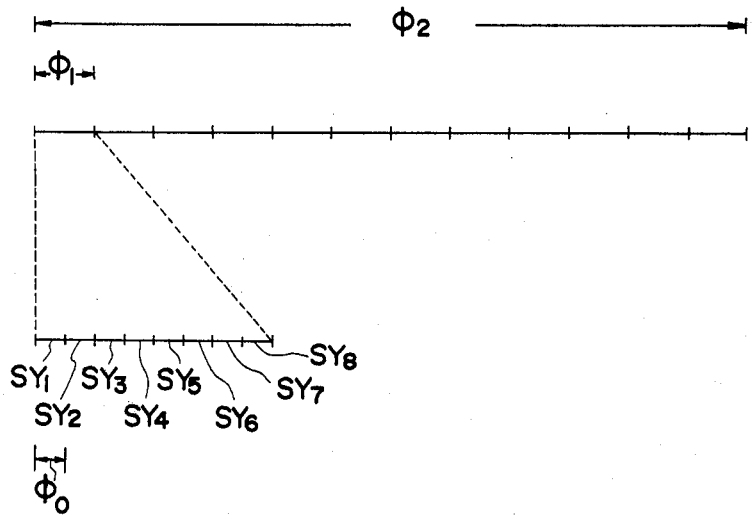
FIG. 4 is a graph showing time relation between clock pulses $\phi_0$, $\phi_1$ and $\phi_2$.

A pitch data generation circuit 21 delivers out pitch data Ki (i=1 to 8) to be used for computation of a tone signal as will be described later in response to a tone color selection signal TC generated by the tone selection circuit 20, the time function t generated by the time function generation circuit 24 and synchronizing signal $SY_1$–$SY_8$. The synchronizing signals $SY_1$–$SY_8$ are provided by parallel outputs of an 8-stage ring counter 26 driven by the output $\phi_0$ of a clock pulse generator 25 as shown in FIG. 2. Chronological relationship between the synchronizing signals $SY_1$–$SY_8$ and the clock pulse $\phi_1$ used for defining channel times is shown in FIG. 4. Each of the synchronizing signals $SY_1$–$SY_8$ has a time slot which is obtained by dividing a time slot defined by the clock pulse $\phi_1$ by eight. The pitch data generation circuit 21 is composed of a read-only memory accessed by the tone selection signal TC, the time function t and the synchronizing signals $SY_1$–$SY_8$.

An envelope signal generation circuit 22 also is composed of a read-only memory accessed by the tone selection signal TC, the time function t and the synchronizing signals $SY_1$–$SY_8$. The circuit 22 outputs an envelope signal $A_i$(i=1 to 8) used for computation of the tone signal in response to the tone selection signal TC, the time function t and the synchronizing signals $SY_1$–$SY_8$.

Figure 5:
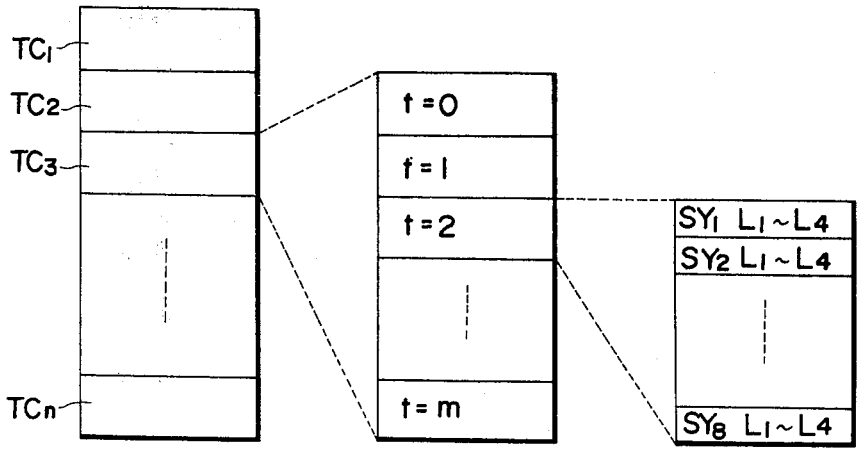
FIG. 5 is a graph showing contents stored in an algorithm control data generation circuit.

A computation or algorithm control data generation circuit 23 receives the tone selection signal Tc, the time function t and the synchronizing signal $SY_1$–$SY_8$ and thereupon outputs 4-bit algorithm or computation control data $L_1$–$L_4$ which determines contents of computation for forming a tone signal. Like the above described pitch data generation circuit 21 and the envelope signal generation circuit 22, the circuit 23 is composed of a read-only memory accessed by the tone selection signal TC, the time function t and the synchronizing signals $SY_1$–$SY_8$. Contents stored in the circuit 23 are diagrammatically shown in FIG. 5. This read-only memory has addresses corresponding to the respective tone colors $TC_1$–$TC_n$ and each of these addresses is divided into addresses t=0 to t=m corresponding to the time function t. The respective addresses t=0 to t=m store algorithm control data $L_1$–$L_4$ corresponding to the synchronizing signals $SY_1$–$SY_8$.

The following Table 1 shows an example of the algorithm control data $L_1$–$L_4$.

TABLE 1

| SY | $L_1$ | $L_2$ | $L_3$ | $L_4$ |
|---|---|---|---|---|
| 1 | 1 | 0 | 0 | 0 |
| 2 | 0 | 0 | 1 | 0 |
| 3 | 1 | 0 | 0 | 0 |
| 4 | 0 | 0 | 0 | 1 |
| 5 | | | | |
| 6 | | | | |
| 7 | | | | |
| 8 | | | | |

In accordance with the algorithm control control data $L_1$–$L_4$ shown in Table 1, the computation by the following equation (5) is implemented:

$$e(t)=A_2 \sin (K_2\omega t+A_1 \sin K_1\omega t)+A_4 \sin (K_4\omega t+A_3 \sin K_3\omega t) \quad (5)$$

Assuming that the algorithm control data $L_1$–$L_4$ shown in Table 1 is outputted by the algorithm control circuit 23, description of the following circuit is made with respect only to a specific channel time.

At the time slot of the synchronizing signal $SY_1$, pitch data $K_1$ is generated by the pitch data generation circuit 21, an envelope signal $A_1$ is generated by the envelope signal generation circuit 22 and algorithm control data ($L_1$–$L_4$) "1000" in which the signal $L_1$ only is "1" is generated by the algorithm control data generation circuit 23.

A signal outputted by the phase angle data generation circuit 3 and representing a phase angle $\omega t$ corresponding to the frequency of a tone for a depressed key is applied to a multiplier 6. To the multiplier 6 is also applied from the pitch data generation circuit 21 the pitch data $K_1$ which is synchronized with the synchronizing signal $SY_1$ so that the multiplier 6 multiplies the phase angle $\omega t$ with the pitch data $K_1$ and outputs a product $K_1\omega t$. This value $K_1\omega t$ is applied to an adder 7. Since at this time no signal has yet been applied to another input of the adder 7, this value $K_1\omega t$ is applied directly to a sinusoidal wave function memory 8 from the adder 7 and a corresponding sinusoidal wave function value $\sin K_1\omega t$ thereby is read out. This value $\sin K_1\omega t$ read from the sinusoidal wave function memory 8 is applied to a multiplier 9 where it is multiplied with the envelope signal $A_1$ outputted by the envelope signal generation circuit 22. The product $A_1 \sin K_1\omega t$ is applied to an adder 10. No signal has yet been applied to another input of the adder 10 at this time so that the value $A_1 \sin K_1\omega t$ is directly loaded from the adder 10 to a register 4 driven by the clock pulse $\phi_0$ through a gate circuit 5 gated by the signal $L_1$.

At the time slot of the synchronizing signal $SY_2$, the pitch data generation circuit 21 generates pitch data $K_2$, the envelope signal generation circuit 22 provides the envelope signal $A_2$ and the algorithm control data generation circuit 23 provides the algorithm control data ($L_1$–$L_4$) "0010" in which the signal $L_3$ only is "1". The multiplier 6 thereupon multiplies the phase angle $\omega t$ provided by the phase angle data generation circuit 3 with the pitch data $K_2$ provided by the pitch data generation circuit 3, supplying a product $K_2\omega t$ to the adder 7. At this time the value $A_1 \sin K_1\omega t$ loaded in the register 4 is applied to another input of the adder 7. Accordingly, the adder 7 adds the value $K_2\omega t$. The output value ($K_2\omega t+A_1 \sin \omega t$) of the adder 7 is applied to the sinusoidal wave memory 8 to read out a corresponding sinusoidal wave function value $\sin (K_2\omega t+A_1 \sin K_1\omega t)$. The sinusoidal wave function value $\sin (K_2\omega t+A_1 \sin K_1\omega t)$ is multiplied in the multiplier 9 with the envelope signal $A_2$ from the envelope signal generation circuit and a product $A_2 \sin (K_2\omega t+A_1 \sin K_1\omega t)$ is multiplied in the multiplier 9 with the envelope signal $A_2$ from the envelope signal generation circuit and a product $A_2 \sin (K_2\omega t+A_1 \sin K_1\omega t)$ is applied to an adder 13 through the adder 10 which has received no signal at another input thereof. At this time, the adder 13 has not yet received a signal at another input thereof. Accordingly, the adder 13 directly delivers out the value $A_2 \sin (K_2\omega t+A_1 \sin K_1\omega t)$ applied thereto and this value is loaded in a latch circuit 14 in response to the signal $L_3$.

At the time slot of the synchronizing signal $SY_3$, the pitch data generation circuit 21 generates pitch data $K_3$, the envelope signal generation circuit 22 an envelope signal $A_2$ and the algorithm control data generation circuit 23 algorithm control data ($L_1$–$L_4$) "1000" in which the signal $L_1$ only is "1". At this time slot, the algorithm control data $L_1$–$L_4$ is the same as that produced at the time slot of the synchronizing signal $SY_1$ so that the same computation as that performed at the time slot of the synchronizing signal $SY_1$ is performed. More specifically, the multiplier 6 multiplies the phase angle $\omega t$ from the phase angle generation circuit 3 with the pitch data $K_3$ from the pitch data generation circuit 21 and applied a product $K_3\omega t$ to the sinusoidal wave function memory 8 to read out a corresponding sinusoidal wave function value $\sin K_3\omega t$. The multiplier 9 multiplies this sinusoidal wave function value with the envelope signal $A_3$ generated by the envelope signal generation circuit 22 and a product $A_3 \sin K_3\omega t$ is loaded in the register 4 through the adder 10 and the gate circuit 5 gated by the signal $L_1$.

At the time slot of the synchronizing signal $SY_4$, the pitch data generation circuit 21 generates pitch data $K_4$, the envelope signal generation circuit 22 the envelope signal $A_4$, and the algorithm control data generation circuit 23 algorithm control data ($L_1$–$L_4$) "0001" in which the signal $L_4$ is "1". At this time slot, the multiplier 6 multiplies the phase angle $\omega t$ from the phase angle data generation circuit 3 with the pitch data $K_4$ from the pitch data generation circuit 21. Then the product $K_4\omega t$ and the value $A_3 \sin K_3\omega t$ stored in the register 4 at the time slot of the synchronizing signal $SY_3$ are added together in the adder 7. The output value ($K_4\omega t+A_3 \sin K_3\omega t$) of the adder 7 is applied to an address input of the sinusoidal wave function memory 8 to read out a corresponding sinusoidal wave function value $\sin (K_4\omega t+A_3 \sin K_4\omega t)$. The output of the memory 8 is multiplied with the envelope value $A_4$ by the multiplier 9 and the product $A_4 \sin (K_4\omega t + A_3 \sin K_3\omega t)$ is applied to an adder 13 through the adder 10. The adder 13 receives at the other input thereof the value $A_2 \sin (K_2\omega t + A_1 \sin K_1\omega t)$ which was loaded in a latch circuit 14 by the signal $L_3$ at the time slot of the synchronizing signal $SY_2$. Accordingly, the adder 13 adds these values together to produce a value $A_2 \sin (K_2\omega t + A_1 \sin K_1\omega t) + A_4 \sin (K_4\omega t + A_3 \sin K_3\omega t)$. This output value of the adder 13 is loaded in a latch circuit 15.

Thus, the signal $e(t) = A_2 \sin (K_2\omega t + A_1 \sin K_2\omega t) + A_4 \sin (K_4\omega t + A_3 \sin K_3\omega t)$ loaded in the latch circuit 15 by computation in accordance with the algorithm control data $L_1$–$L_4$ from the algorithm control data generation circuit 23 is stored in an accumulator 16.

A similar computation is carried out at each channel time and a result of computation for each channel time is stored in the accumulator 16. The results of computation with respect to the first through twelfth channels stored in the accumulator 16 are in turn loaded in a latch circuit 17 at a timing of a clock pulse $\phi_2$. The clock pulse $\phi_2$ is provided from a final stage of a 12-stage ring counter 27 which is driven by the clock pulse $\phi_1$ defining each channel time as shown in FIG. 2. One shot of the clock pulse $\phi_2$ is produced at every twelve shots of the clock pulse $\phi_1$. The accumulator 16 is cleared by a signal obtained by delaying the clock pulse $\phi_2$ by, for example, the clock pulse $\phi_0$ The value stored in the latch circuit 17 is applied to a digital-to-analog converter (DAC) 18 where the value is converted to a corresponding analog signal. The above description has been made about an operation performed at a certain time point represented by the time function e.g. $t=1$, generated by the time function generation circuit 24. Similar computation is carried out in accordance with the time function t generated by the time function generation circuit 24 and, accordingly, an analog signal which varies with the time function t is produced by the digital-to-analog converter 18. The analog signal outputted by the digital-to-analog converter 18 in the above described manner is applied to a sound system 19 for sounding of a musical tone.

The above description has been made with respect to a case wherein the algorithm control data $L_1$–$L_4$ as shown in Table 1 is generated by the algorithm control data generation circuit 23. Description will now be made with respect to a case wherein algorithm control data $L_1$–$L_4$ as shown in the following Table 2 is generated by the algorithm control data generation circuit 23.

TABLE 2

| SY | $L_1$ | $L_2$ | $L_3$ | $L_4$ |
|---|---|---|---|---|
| 1 | 0 | 1 | 0 | 0 |
| 2 | 1 | 0 | 0 | 0 |
| 3 | 0 | 0 | 1 | 0 |
| 4 | 1 | 0 | 0 | 0 |
| 5 | 1 | 0 | 0 | 0 |
| 6 | 0 | 0 | 0 | 1 |
| 7 | | | | |
| 8 | | | | |

By this algorithm control data $L_1$–$L_4$, computation of the following equation (6) is implemented:

$$e(t) = A_3 \sin (K_3\omega t + A_2 \sin K_2\omega t + A_1 \sin K_1\omega t) + A_6 \sin \{K_6\omega t + A_5 \sin (K_5\omega t + A_4 \sin K_4\omega t)\} \quad (6)$$

As a time slot of the synchronizing signal $SY_1$, the pitch data generation circuit 21 generates pitch data $K_1$, the envelope signal generation circuit 22 an envelope signal $A_1$ and the algorithm control data generation circuit 23 algorithm control data ($L_1$–$L_4$) "0100" in which the signal $L_2$ is "1". This enables the gate 12. Accordingly, the output of the multiplier 6 which multiplies the phase angle $\omega t$ generated by the phase angle data generation circuit 3 with the pitch data $K_1$ generated by the pitch data generation circuit 21 is applied to the sinusoidal wave function memory 8 through the adder 7 which has not received any signal at the other input thereof. A corresponding sinusoidal wave function value $\sin K_1\omega t$ is read from the memory 8. This value is multiplied in the multiplier 9 with the envelope signal $A_1$ generated by the envelope signal generation circuit 22 and the product $A_1 \sin K_1\omega t$ is loaded in the register 11 driven by the clock pulse $\phi_0$ through the adder 10 which has not received any signal at the other input thereof and the gate 12 which has been enabled by the signal $L_2$.

At a time slot of the synchronizing signal $SY_2$, the pitch data generation circuit 21 generates pitch data $K_2$, the envelope signal generation circuit 22 an envelope signal $A_2$ and the algorithm control data generation circuit 23 algorithm control data ($L_1$–$L_4$) "1000" in which te signal $L_1$ is "1". Thereupon the gate 5 is enabled. A value $A_2 \sin K_2\omega t$ computed in the same manner as described above is applied to the adder 10 through the multiplier 6, the adder 7, the sinusoidal wave function memory 8 and the multiplier 9. The adder 10 adds the value $A_1 \sin K_1\omega t$ loaded in the register 11 at the time slot of the synchronizing signal $SY_1$ and being presently applied to the other input of the adder 10 and the value $A_2 \sin K_2\omega t$ together and supplies the sum $A_1 \sin K_1\omega t + A_2 \sin K_2\omega t$ to the register 4 through the gate 5.

At a time slot of the synchronizing signal $SY_3$, the pitch data generation circuit 21 generates pitch data $K_3$, the envelope signal generation circuit 22 an envelope signal $A_3$ and the algorithm control data generation circuit 23 algorithm control data ($L_1$–$L_4$) "0010" in which the signal $L_3$ is "1". At this time slot, the value $K_3\omega t$ provided by the multiplier 6 and the value $A_1 \sin K_1\omega t + A_2 \sin K_2\omega t$ which was loaded in the register 4 at the time slot of synchronizing signal $SY_2$ are added together in the adder 7 and a corresponding sinusoidal wave function value $\sin (K_3\omega t + A_1 \sin K_1\omega t + A_2 \sin K_2\omega t)$ is read from the sinusoidal wave function memory 8 in response to the sum of the addition in the adder 7. The read out value is multiplied in the multiplier 9 with the envelope signal $A_3$ and the product $A_3 \sin (K_3\omega t + A_1 \sin K_1\omega t + A_2 \sin K_2\omega t)$ is loaded in the latch circuit 14 by the signal $L_3$ through the adders 10 and 13.

At a time slot of the synchronizing signal $SY_4$, the pitch data generation circuit 21 generates pitch data $K_4$, the envelope signal generation circuit 22 an envelope signal $A_4$ and the algorithm control data generation circuit 23 algorithm control data ($L_1$–$L_4$) "1000" in which the signal $L_1$ is "1". This enables the gate 5. Accordingly, a computed value $A_4 \sin K_4\omega t$ is loaded in the register 4 through the multiplier 6, adder 7, sinusoidal wave function memory 8, multiplier 9, adder 10 and gate 5.

At a time slot of the synchronizing signal $SY_5$, the pitch data generation circuit 21 generates pitch data $K_5$, the envelope signal generation circuit 22 an envelope signal $A_5$ and the algorithm control data generation circuit 23 algorithm data ($L_1$–$L_4$) "1000" in which the signal $L_1$ is "1". This enables the gate 5. The output value $K_5\omega t$ of the multiplier 6 and the value $A_4 \sin K_4\omega t$ loaded in the register 4 at a time slot of the synchronizing signal $SY_4$ are added together in the adder 7 and a corresponding sinusoidal wave function value sin ($K_5\omega t + A_4 \sin K_4\omega t$) is read from the sinusoidal wave function memory 8 in response to the sum of the addition in the adder 7. The read out value is multiplied with the envelope signal $A_5$ in the multiplier 9 and the product $A_5 \sin (K_5\omega t + A_4 \sin K_4\omega t)$ is loaded in the register 4 through the adder 10 and the gate 5.

At a time slot of the synchronizing signal $SY_6$, the pitch data generation circuit 21 generates pitch data $K_6$, the envelope signal generation circuit 22 an envelope signal $A_6$ and the algorithm control data generation circuit 23 algorithm data ($L_1$–$L_4$) "0001" in which the signal $L_4$ is "1". At this time slot, the output value $K_6\omega t$ of the multiplier 6 and the value $A_5 \sin (K_5\omega t + A_4 \sin K_4\omega t)$ which was loaded in the register 4 at the time slot of the synchronizing signal $SY_5$ are added together in the adder 7 and a corresponding sinusoidal wave function value sin $\{K_6\omega t + A_5 \sin (K_5\omega t + A_4 \sin K_4\omega t)\}$ is read from the sinusoidal wave function memory 8 in response to the sum value $K_6\omega t + A_5 \sin (K_5\omega t + A_4 \sin K_4\omega t)$. This sinusoidal wave function value is applied to the multiplier 9 to be multiplied with the envelope signal $A_6$. The product of the multiplication $A_6 \sin \{K_6\omega t + A_5 \sin (K_5\omega t + A_4 \sin K_4\omega t)\}$ is applied to the adder 13 through the adder 10. This value is added in the adder 13 to the value $A_3 \sin (K_3\omega t + A_2 \sin K_2\omega t + A_1 \sin K_1\omega t)$ which was loaded in the latch circuit 14 at the time slot of the synchronizing signal $SY_3$. The sum $A_3 \sin (K_3\omega t + A_2 \sin K_2\omega t + A_1 \sin K_1\omega t) + A_6 \sin \{K_6\omega t + A_5 \sin (K_5\omega t + A_4 \sin K_4\omega t)\}$ is loaded in the latch circuit 15 in response to the signal $L_4$.

The above described operation is made within one channel time just as the operation performed in accordance with Table 1. An operation similar to the one described above is performed during each channel time and the result of computation for each channel stored in the latch circuit 15 is applied to the accumulator 16. Contents of the accumulator 16 are supplied, in the same manner as described above, to a sound system 19 through the latch circuit 17 operated by the clock pulse $\phi_2$ and the digital-to-analog converter 18.

The above described operations are only few examples of various operations which the device according to the invention is capable of performing.

It will be understood that if a algorithm control data $L_1$–$L_4$ as shown in the following Table 3 is produced in accordance with the synchronizing signals $SY_1$–$SY_8$, an equation $$e(t) = A_2 \sin (K_2\omega t + A_1 \sin K_1\omega t) + A_4 \sin (K_4\omega t + A_3 \sin K_3\omega t) + A_6 \sin (K_6\omega t + A_5 \sin K_5\omega t) + A_8 \sin (K_8\omega t + A_7 \sin K_7\omega t)$$

is implemented whereby computation of "four series with one term modulation" can be carried out.

TABLE 3

| SY | $L_1$ | $L_2$ | $L_3$ | $L_4$ |
|---|---|---|---|---|
| 1 | 1 | 0 | 0 | 0 |
| 2 | 0 | 0 | 1 | 0 |
| 3 | 1 | 0 | 0 | 0 |
| 4 | 0 | 0 | 1 | 0 |
| 5 | 1 | 0 | 0 | 0 |

TABLE 3-continued

| SY | $L_1$ | $L_2$ | $L_3$ | $L_4$ |
|---|---|---|---|---|
| 6 | 0 | 0 | 1 | 0 |
| 7 | 1 | 0 | 0 | 0 |
| 8 | 0 | 0 | 0 | 1 |

If algorithm control data $L_1$–$L_4$ as shown in the following Table 4 is sequentially produced, an equation $$e(t) = \sum_{i=1}^{8} A_i \sin K_i\omega t$$

is implemented.

TABLE 4

| SY | $L_1$ | $L_2$ | $L_3$ | $L_4$ |
|---|---|---|---|---|
| 1 | 0 | 0 | 1 | 0 |
| 2 | 0 | 0 | 1 | 0 |
| 3 | 0 | 0 | 1 | 0 |
| 4 | 0 | 0 | 1 | 0 |
| 5 | 0 | 0 | 1 | 0 |
| 6 | 0 | 0 | 1 | 0 |
| 7 | 0 | 0 | 1 | 0 |
| 8 | 0 | 0 | 0 | 1 |

In this case, computation for producing a musical tone is performed not in accordance with the above described FM system (i.e. Tables 1–3) but in accordance with the harmonic synthesis system.

The above described algorithm control data $L_1$–$L_4$ is stored in the algorithm control data generation circuit 23 in correspondence to the tone colors $TC_1$–$TC_n$ in such a manner that each control data corresponds to optimum algorithm for a selected tone color. Accordingly, computation according to the optimum algorithm for the selected tone color is implemented whereby a tone signal which is most suited to the selected tone color (property) can be formed.

It should be noted that this invention is applicable to a case where computation for forming a tone signal is carried out by employing an equation other than the above described equations.

It should also be understood that the calculation circuit such as the adders and multipliers and manners of connecting the gates and latch circuits are not limited to those illustrated in FIG. 1 but modifications can be made where applicable.

What is claimed is:

1. An electronic musical instrument comprising:

a tone property seleting device for selecting a property of tones to be produced;

keyboard keys for designating note names of tones to be produced;

a computation control data generation circuit for storing different sets of computation control data corresponding to respective properties of tones to be produced and delivering out a selected set of the control data corresponding to the selected property of each tone to be produced; and a tone signal forming circuit including computation performing circuitry for implementing a set of arithmetic or trigonometric computations determined from among a plurality of available implementable computations in accordance with the computation control data delivered by said computation control data generation circuit and thereby forming a tone signal of a note designated by said key and of a property selected by said selecting device, each set of control data causing said tone signal forming circuit to implement a set of different mathematical computations, whereby as a result of said different computations, a tone of different property is generated.

2. An electronic musical instrument as defined in claim 1 wherein said computation performing circuitry consists of combinations of arithmetic circuits connected by a plurality of gates, which gates are sequentially controlled by said control data for implementing each of said mathematical computations.

3. An electronic musical instrument according to claim 1 wherein said tone is produced in real time, and wherein said tone signal forming circuit repetitively implements the complete set of mathematical computations at a fixed clock rate to evaluate consecutive sample point amplitudes of the tone being produced.

4. In a real time keyboard polyphonic electronic musical instrument of the type in which a tone generator is time shared and in which consecutive phase angle information corresponding to selected keys is supplied in assigned time-division time slots, the improvement comprising:

a set of circuits interconnectable by gates to perform consecutive different arithmetic calculations during each time slot utilizing the phase angle information supplied in that time slot, a computation control data generator means for supplying during each assigned time slot a respective set of computation control data signals for selectively operating said gates, said circuits thereby performing during each time slot a set of plural arithmetic computations so as to calculate the waveform amplitude for the note assigned to that time slot, for the sample point corresponding to said supplied phase angle information, and tone color selection means for causing said computation control data generator means to supply a selected one of a plurality of different sets of computation control data, each such set causing said circuits effectively to be interconnected in different ways so as to implement a different set of arithmetic computations and thereby produce a tone of different color.

5. In a real time keyboard polyphonic electronic musical instrument of the type in which a tone generator is time shared and in which key codes corresponding to selected keys are supplied in assigned time slots of repetitive time share cycles, and in which for each assigned time slot a phase angle data generator provides consecutive phase angle information $\omega t$ which represents the phase angles of consecutive sample points at which each tone waveshape amplitude is evaluated in real time, the improvement for providing tones of selectable tonal characteristics, comprising:

a set of circuits interconnectable by gates to perform consecutive different arithmetic calculations during each time slot utilizing the value $\omega t$ supplied in that time slot, synchronization timing means for producing during each time slot a set of consecutive subinterval timing pulses, a computation control data generator means for supplying in synchronism with said subinterval timing pulses a respective set of computation control data signals for selectively operating said gates, said circuits thereby performing during each time slot a consecutive set of arithmetic calculations utilizing said supplied value $\omega t$, said calculations being selected so as to calculate in each time slot the waveform sample point amplitude for the phase angle $\omega t$ for the selected note assigned to that time slot, and tone color selection means, cooperating with said computation control data generator means, for causing said generator means to supply a selectable one of a plurality of different sets of computation control data, each such different set causing said circuits to be effectively interconnected in different ways and thereby implement a different set of arithmetic calculations and accordingly produce a tone of different color.

6. An electronic musical instrument of the type in which a musical tone waveshape is generated in real time by computation of waveshape amplitudes at successive sample points identified by consecutive phase angle values, the improvement for implementing selectable tone color, comprising:

a set of circuits interconnectable in response to control signals to perform different mathematical operations utilizing said consecutive phase angle values, a computation control data generator for providing to said circuits, during the time interval allotted for computation of each sample point amplitude, a set of control signals causing said circuits to be interconnected so as to implement a corresponding set of mathematical operations that comprise a tone synthesis computation, said circuits thereby computing the waveshape amplitude for said each sample point, and tone color selector means, cooperating with said data generator, for causing said data generator to provide to said circuits alternative sets of control signals, each of which sets causes said circuits to be interconnected differently so as to implement respectively different tone synthesis computations.

* * * * *